US011266184B2

(12) United States Patent
McMahon

(10) Patent No.: US 11,266,184 B2
(45) Date of Patent: Mar. 8, 2022

(54) MICROPHONE MASK

(71) Applicant: SoundHound, Inc., Santa Clara, CA (US)

(72) Inventor: Kathleen Worthington McMahon, Woodside, CA (US)

( * ) Notice: Subject to any disclaimer, the term of this patent is extended or adjusted under 35 U.S.C. 154(b) by 0 days.

(21) Appl. No.: 16/838,219

(22) Filed: Apr. 2, 2020

(65) Prior Publication Data

US 2020/0315266 A1 Oct. 8, 2020

(30) Foreign Application Priority Data

Apr. 2, 2019 (JP) ..... JP2019-070725

(51) Int. Cl.
*A41D 13/11* (2006.01)
*A41D 1/00* (2018.01)
*A42B 3/30* (2006.01)

(52) U.S. Cl.
CPC ..... *A41D 1/002* (2013.01); *A41D 13/1161* (2013.01); *A42B 3/30* (2013.01)

(58) Field of Classification Search
CPC .... A41D 1/002; A41D 13/1161; A41D 1/005; A41D 13/11; A42B 3/30
See application file for complete search history.

(56) References Cited

U.S. PATENT DOCUMENTS 3,064,089 A * 11/1962 Ward ..... H04B 11/00 381/180
3,540,442 A * 11/1970 Holloway ..... A62B 18/08 128/201.19
4,072,831 A * 2/1978 Joscelyn ..... H04R 1/083 381/344
5,533,131 A 7/1996 Kury
5,990,793 A * 11/1999 Bieback ..... A62B 18/08 2/5
2002/0077838 A1 6/2002 Dutta
2002/0166557 A1 11/2002 Cooper
2005/0096096 A1* 5/2005 Birli ..... H04B 1/385 455/569.1
2007/0127659 A1 6/2007 McClory et al.
2008/0195390 A1 8/2008 Almagro
2009/0060169 A1 3/2009 Manne
2015/0370320 A1 12/2015 Connor
(Continued)

FOREIGN PATENT DOCUMENTS

CN 204181007 U 3/2015
CN 205902838 U 1/2017
(Continued)

OTHER PUBLICATIONS

S. Egusa, et al., Multimaterial piezoelectric fibres. Nature materials. Aug. 2010;9(8):643-8.
(Continued)

*Primary Examiner* — Tajash D Patel

(57) ABSTRACT

A mask is worn to cover a mouth of a wearer, and includes a mask main body made of a cloth-like material, a microphone arranged on the mask main body, and configured to collect voice of the wearer, a cord connected to the microphone, and a support portion that supports the microphone. The support portion is joined to a peripheral portion of the mask main body and higher in rigidity than the mask main body.

10 Claims, 12 Drawing Sheets

(56) References Cited

U.S. PATENT DOCUMENTS

| | | | | |
|---|---|---|---|---|
| 2016/0057618 | A1 | 2/2016 | Shorr | |
| 2017/0332710 | A1* | 11/2017 | Bot | A41D 13/1161 |
| 2017/0360121 | A1* | 12/2017 | Hamilton | F21V 17/10 |
| 2018/0078798 | A1* | 3/2018 | Fabian | A62B 7/10 |
| 2018/0280738 | A1* | 10/2018 | Gabriel | A62B 18/025 |

FOREIGN PATENT DOCUMENTS

| | | | |
|---|---|---|---|
| JP | 3049954 | U | 6/1998 |
| JP | 3196741 | U | 4/2015 |
| JP | 3200009 | U | 10/2015 |
| KR | 20150068743 | A | 6/2015 |
| RU | 166740 | U1 | 12/2016 |

OTHER PUBLICATIONS

Aidin Delnavaz, et al., Electromagnetic micro-power generator for energy harvesting from breathing. InIECON 2012—38th Annual Conference on IEEE Industrial Electronics Society Oct. 25, 2012 (pp. 984-988). IEEE.

Xin Lu, et al., Piezoelectric microstructured fibers via drawing of multimaterial preforms. Scientific reports. Jun. 6, 2017;7(1):1-2.

ロキプロ, Ameba, Nov. 5, 2015, https://web.archive.org/web/20160702171238/http://ameblo.jp/lokius/entry-12092043194.html.

* cited by examiner

MICROPHONE MASK

This patent application claims priority to Japan patent application 2019-070725 filed 2019 Apr. 2 with title マスク and China patent application 201910485734.6 fled 2019 Jun. 5 with title 口罩.

BACKGROUND

Field of the Invention

The present disclosure relates to a face mask.

Description of the Background Art

A microphone has conventionally been provided in a mask to collect voice uttered by a wearer who wears the mask. Such a mask is described in US Patent Publication No. 2002/077838, US Patent Publication No. 2002/166557, US Patent Publication No. 2007/127659, US Patent Publication No. 2008/195390, US Patent Publication No. 2009/060169, US Patent Publication No. 2016/057618, Russian Utility Model No. 166740, and Korean Patent Publication No. 10-2015-0068743.

US Patent Publication No. 2015/037320 discloses conversion of voice in a conversation into an electrical signal by using a piezoelectric element. The piezoelectric element is described in "Multimaterial piezoelectric fibres," S. Egusa et al., published on Jul. 11, 2010, Macmillan Publishers Limited, NATURE MATERIALS VOL. 9 and "Piezoelectric Microstructured Fibers via Drawing of Multimaterial Preforms," Xin Lu et al., published on Jun. 6, 2017, Scientific Reports, the Internet <https://www.nature.com/articles/s41598-017-01738-9>.

"Electromagnetic micro-power generator for energy harvesting from breathing." Aidin Denavaz et al., published on Oct. 25, 2012, IEEE. IECON 2012-38th Annual Conference on IEEE Industrial Electronics Society describes a mechanism that converts a breath pressure into electric power.

SUMMARY

Audibility of voice of a wearer can be enhanced by attaching a microphone to a mask. From a different point of view, privacy of contents of a conversation by the wearer of the mask can also be protected. Achievement of such effects with increase in cost being suppressed has been demanded. The disclosure in the background art may not have necessarily been sufficient in these aspects.

An object of the present disclosure is to provide a mask capable of suppressing lowering in audibility of voice of a wearer and protecting privacy of contents of a conversation with relatively low cost.

A mask according to one embodiment of the present disclosure is worn to cover a mouth of a wearer, and the mask includes a mask main body made of a cloth-like material, a microphone arranged on the mask main body, and configured to collect voice of the wearer, a cord connected to the microphone, and a support portion that supports the microphone. The support portion is joined to a peripheral portion of the mask main body and higher in rigidity than the mask main body.

A mask according to another embodiment of the present disclosure includes a mask main body made of a cloth-like sheet containing piezoelectric fibers and wires, at least two electrodes, and a communication module connected to the at least two electrodes. Each of the wires has an end connected to only one of the at least two electrodes, and the wires connected to respective different electrodes intersect with the piezoelectric fibers.

According to the present disclosure, lowering in audibility of voice of a wearer can be suppressed and privacy of contents of a conversation can be protected. Such effects can be achieved with relatively low cost.

DETAILED DESCRIPTION

Embodiments of the present disclosure will be described below. The same or corresponding elements use the same reference numbers and description thereof may not be repeated.

When the number or an amount is mentioned in an embodiment described below, the scope of the present disclosure is not necessarily limited to the number or the amount unless otherwise specified. In the embodiment below, each component is not necessarily essential in the present disclosure unless otherwise specified. Combination of matters described in different embodiments are also possible.

Figure 1:
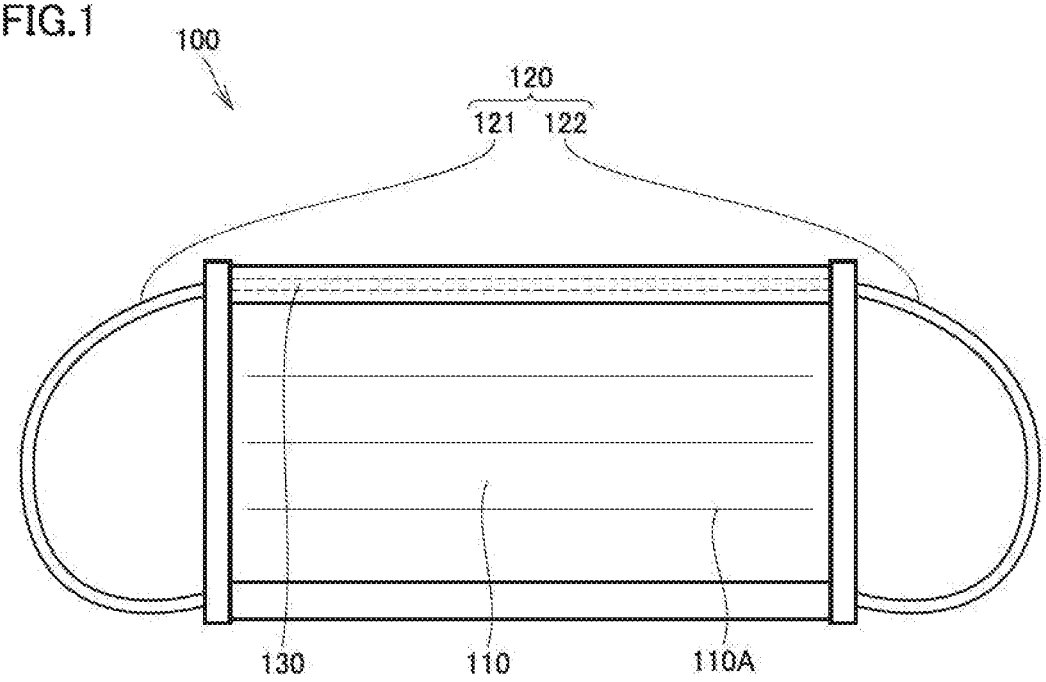
FIG. 1 is a front view of a mask according to a first embodiment.

FIG. 1 is a front view of a mask according to a first embodiment. As shown in FIG. 1, a mask 100 includes a mask main body 110, a strap portion 120, and a fitting portion 130.

Mask 100 may be a disposable mask that is thrown away after it is used once or may be suitable for repeated use.

Figure 2:
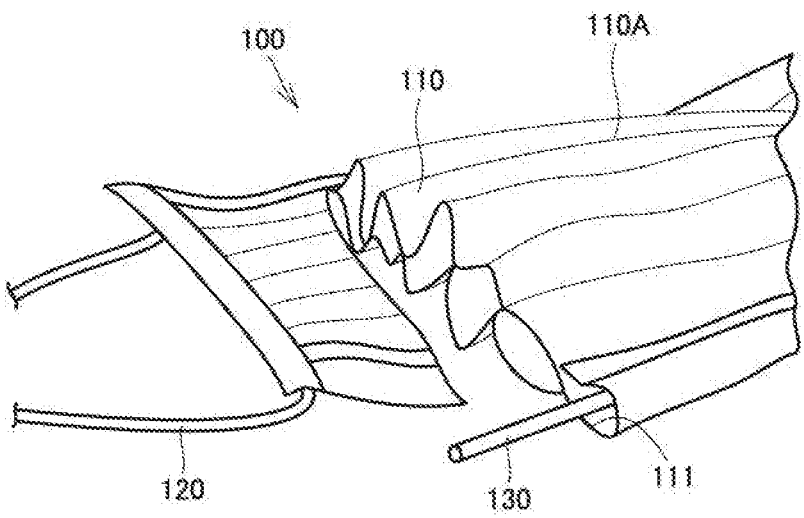
FIG. 2 is a partially exploded perspective view of the mask according to the first embodiment.

FIG. 2 is a partially exploded perspective view of mask 100. As shown in FIG. 2, mask main body 110 includes a pleated portion 110A. With pleated portion 110A, mask 100 can be spread over a face of a wearer in a vertical direction.

Mask main body 110 is made of a cloth-like material. The cloth-like material may be made, for example, of paper or may contain synthetic fibers or natural fibers. The cloth-like material may include a non-woven fabric, a textile, and a knitted product. For example, polyolefin-based synthetic fibers can be employed as the synthetic fibers, however, other man-made fibers may be employed. For example, cotton can be employed as natural fibers. However, other natural fibers may be employed. Mask main body 110 forms a filter in mask 100. Mask main body 110 made from a cloth-like member may be replaced each time mask 100 is used.

Mask main body 110 may be formed of a material that does not much deteriorate even though the mask is washed with a detergent. In this case, repeated use of mask 100 is facilitated.

Strap portion 120 includes left and right strap members 121 and 122. Strap members 121 and 122 each form an elastic loop. A wearer can thus wear mask 100 by putting strap members 121 and 122 over left and right ears of the wearer.

Strap members 121 and 122 may be formed like a string or a band. Though strap members 121 and 122 in the form of a string are made, for example, of rubber, another material may be employed. Though strap members 121 and 122 in the form of the band contain, for example, polyolefin-based or polyurethane-based synthetic fibers, another material may be employed.

Fitting portion 130 is inserted into a channel 111 formed in mask main body 110. Though fitting portion 130 shown in FIG. 2 is made from a linear member, it may be made from a member in a form of a flat band. Though fitting portion 130 is composed, for example, of a polyolefin-based resin, another material may be employed.

In mask 100, fitting portion 130 is provided at an upper end (an end located above the mouth of the wearer) of mask main body 110. Fitting portion 130 extends in a lateral direction on the face of the wearer. Fitting portion 130 may be provided at a lower end (an end located below the mouth of the wearer) of mask main body 110 or at both of the upper and lower ends of mask main body 110. A microphone 140 which will be described later is attached to fitting portion 130. Fitting portion 130 forms a support portion that supports microphone 140. Fitting portion 130 is higher in rigidity than mask main body 110. Fitting portion 130 can thus support microphone 140 in a stable manner. The fitting portion 130 is rigid enough to support microphone 140.

Though mask main body 110 and fitting portion 130 are made from separate members in the present embodiment, the scope of the present disclosure is not limited thereto. Fitting portion 130 may be provided by increasing rigidity of a part of the cloth-like material that forms mask main body 110. Fitting portion 130 is not limited to a fitting portion that is directly joined to mask main body 110. Fitting portion 130 may be joined to mask main body 110 with another member being interposed.

Figure 3:
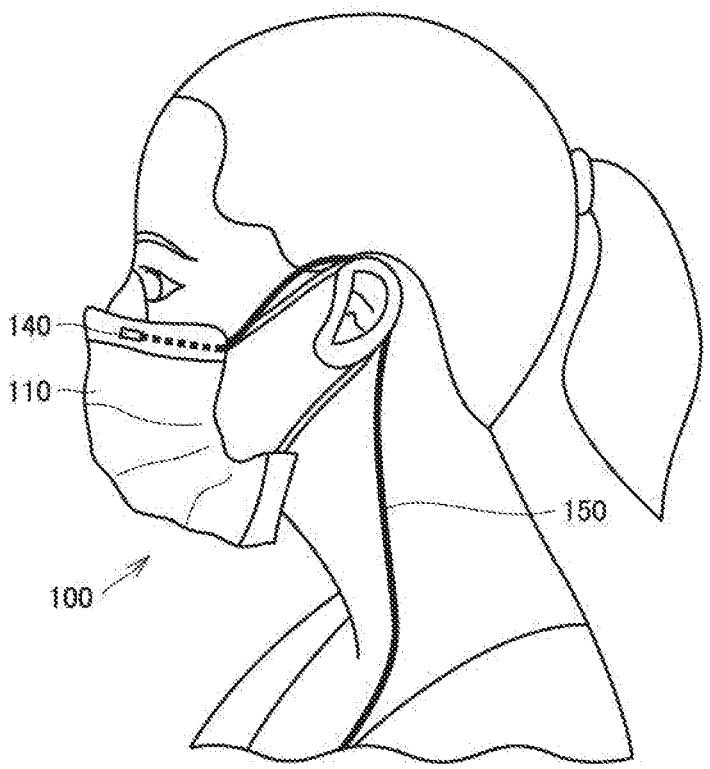
FIG. 3 is a diagram showing a state that a wearer wearing the mask according to the first embodiment.

FIG. 3 is a diagram showing a wearer wearing mask 100. As shown in FIG. 3, mask 100 is worn to cover the mouth of the wearer. The upper end of mask main body 110 is located on the nose of the wearer. Fitting portion 130 provided at the upper end of mask main body 110 can be deformed in conformity with the shape of the nose of the wearer. A feeling of fitting of mask 100 to the wearer can thus be improved. Fitting portion 130 rests on the nose of the wearer in a stable manner.

Microphone 140 is arranged at the upper end of mask main body 110. Though microphone 140, together with fitting portion 130, is accommodated in channel 111 formed in mask main body 110 in the example in FIG. 3, a form of installation of microphone 140 is not necessarily limited as such.

Microphone 140 can collect the voice of a wearer. Though a microphone, for example, lighter than 250 grams is employed as microphone 140, microphone 140 may be equal to or heavier than 250 grams.

Specifically, CMC-3015-44L100 (CUI Inc.) can be employed as microphone 140. Zero-Height SiSonic™ SPU0410LR5H-QB (Knowles Electronics LLC) can also be employed. Specific examples of microphone 140 are not limited to the above.

Microphone 140 may be provided as being removable from mask main body 110 in a reusable state or may also be provided as not being removable from mask main body 110.

A cord 150 is connected to microphone 140. Cord 150 has the other end connected to a device. Examples of the device include a transmitter that can transmit an audio signal. Though specific examples of the transmitter include a smartphone, the specific examples are not limited thereto.

Though a part of cord 150, together with fitting portion 130 and microphone 140, is accommodated in channel 111 formed in mask main body 110, a form of installation of cord 150 is not limited as such. A signal of voice collected by microphone 140 is transmitted to a device through cord 150. Electric power necessary for microphone 140 can be supplied from the device through cord 150.

As shown in FIG. 3, cord 150 is connected to mask main body 110 in the vicinity of a position where mask main body 110 is connected to strap portion 120. Cord 150 can thus be hung comfortably from one ear of the wearer.

Microphone 140 can be provided at a position displaced outward from a centerline of the face of the wearer by approximately ¾ inch (approximately 1.9 cm). By doing so, microphone 140 can be arranged at a position corresponding to a position between the nose and a cheek of the wearer. The position is less displaced by movement of the face of the wearer and also relatively low in interference with collection of voice. The position where microphone 140 is provided is not limited to the position described here.

Figure 4:
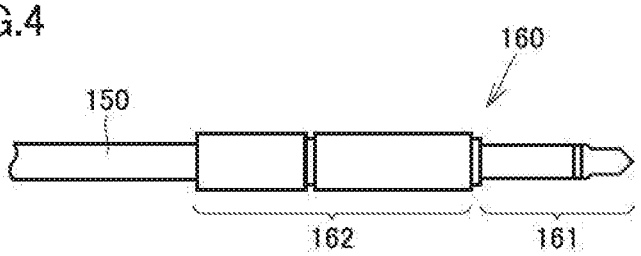
FIG. 4 is a diagram showing an exemplary end of a cord in the mask according to the first embodiment.

FIG. 4 is a diagram showing an example of the other end of cord 150. As shown in FIG. 4, the other end of cord 150 is provided with a terminal portion 160. Terminal portion 160 is in a shape insertable into a general lack provided in a device such as a smartphone. Terminal portion 160 includes an insertion portion 161 that is a portion to be inserted in a device and a non-insertion portion 162 that is a portion exposed to the outside without being inserted in a device. A metal portion is exposed in insertion portion 161. Non-insertion portion 162 is covered with an insulator such as a resin.

Figure 5:
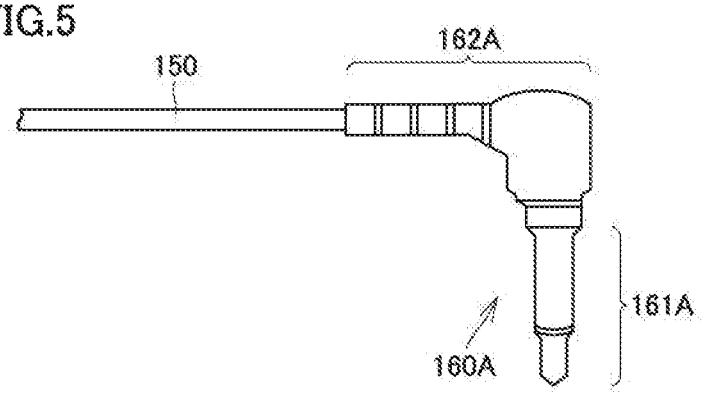
FIG. 5 is a diagram showing another exemplary end of the cord in the mask according to the first embodiment.

FIG. 5 is a diagram showing a terminal portion 160A as a modification of terminal portion 160. In terminal portion 160A, an insertion portion 161A and a non-insertion portion 162A intersect with each other perpendicularly to each other.

Figure 6:
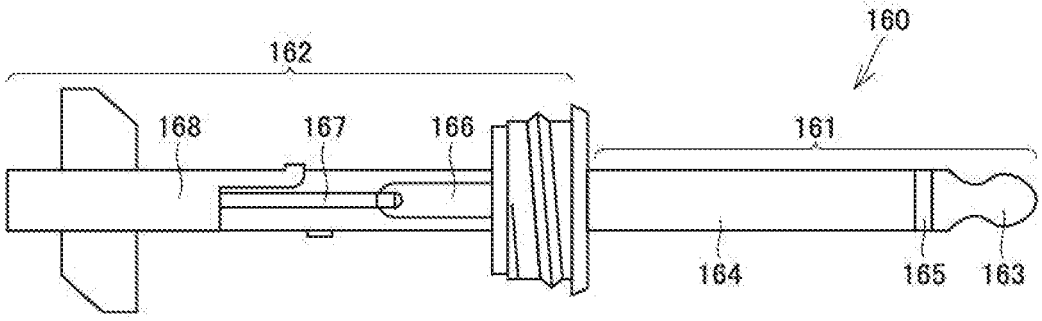
FIG. 6 is a diagram showing an exemplary structure of a terminal shown in FIGS. 4 and 5.

FIG. 6 is a diagram showing an internal structure of terminal portion 160. FIG. 6 does not show a resin that covers non-insertion portion 162.

As shown in FIG. 6, insertion portion 161 includes a tip portion 163, a sleeve portion 164, and an insulating portion 165. Tip portion 163 and sleeve portion 164 that are insulated from each other by insulating portion 165. Non-insertion portion 162 includes a tip portion 166, a normal phase portion 167, and a reverse phase portion 168. Tip portion 166 and normal phase portion 167 are connected to tip portion 163 of insertion portion 161. Reverse phase portion 168 is connected to sleeve portion 164 of insertion portion 161.

A signal transmitted to normal phase portion 167 is transmitted to a device through tip portion 163. A signal transmitted to reverse phase portion 168 is transmitted to the device through sleeve portion 164. A signal of voice collected by microphone 140 is thus appropriately transmitted to the device.

Figure 7:
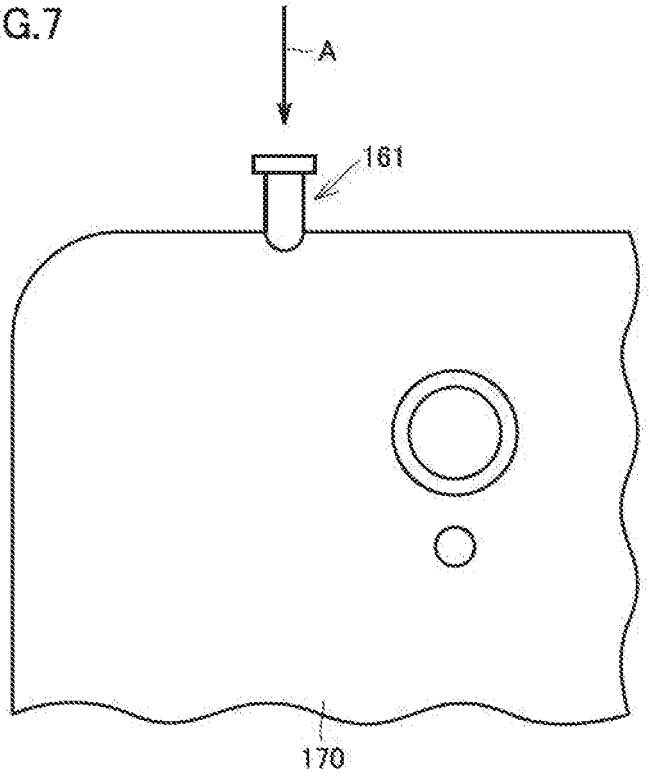
FIG. 7 is a diagram showing insertion of the terminal shown in FIGS. 4 and 5 into a device.

FIG. 7 is a diagram showing insertion of terminal portion 160 (insertion portion 161) at the other end of cord 150 into a device 170. In the state shown in FIG. 7, insertion portion 161 has not completely been inserted in device 170 but approximately half of insertion portion 161 has been inserted in device 170. FIG. 7 does not show non-insertion portion 162.

A form of cord 150 and terminal portion 160 is not limited to the illustration in FIGS. 4 to 7 and can variously be modified.

Figure 8:
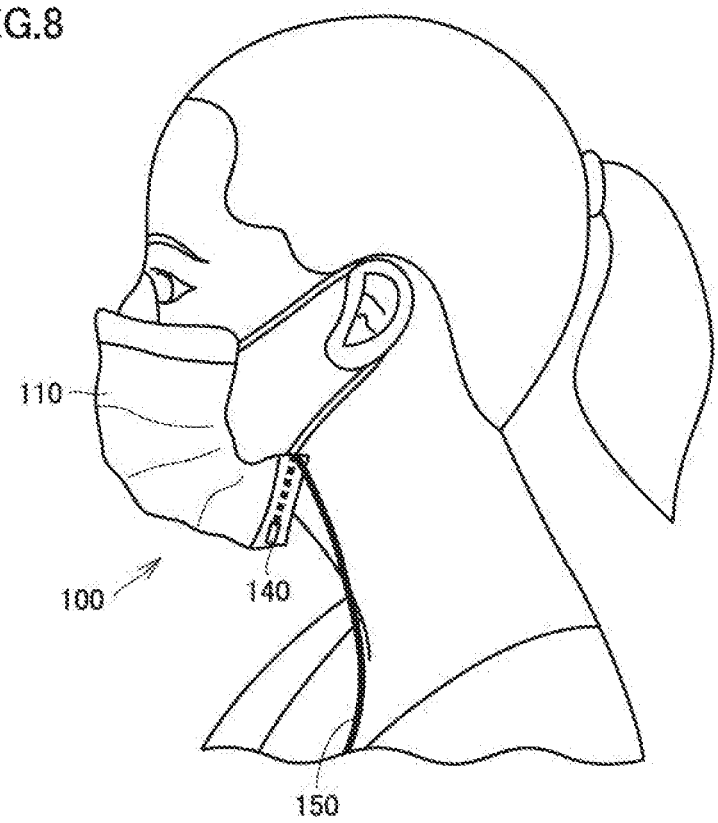
FIG. 8 is a diagram showing a state that a wearer wearing a modification of the mask according to the first embodiment.

FIG. 8 is a diagram showing a state of a wearer wearing a modification of mask 100. In the example shown in FIG. 8, microphone 140 is provided at the lower end (the end located below the mouth of the wearer) of mask main body 110. In this case, fitting portion 130 is also provided at the lower end of mask 100.

Figure 9:
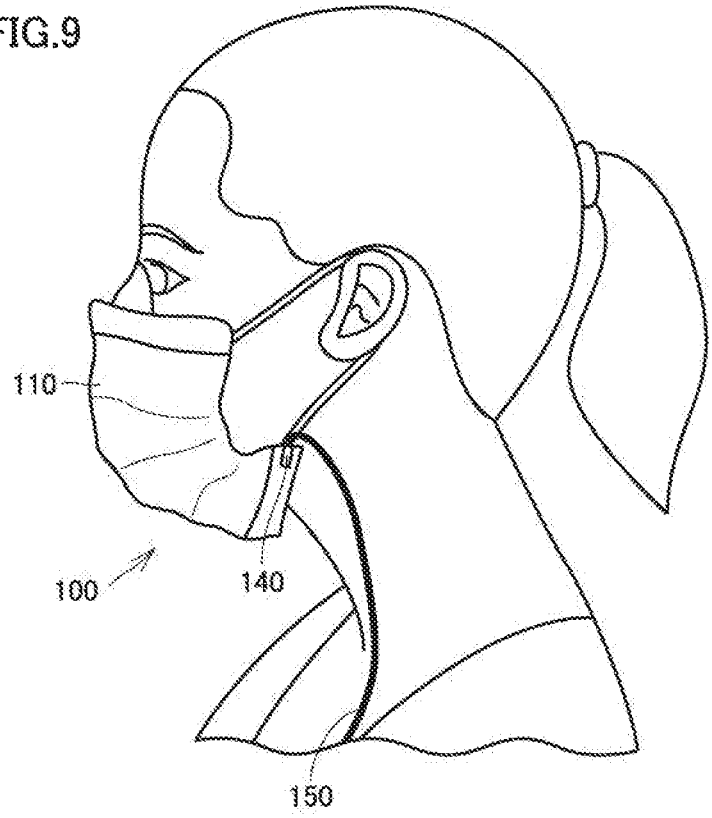
FIG. 9 is a diagram showing a state that a wearer wearing another modification of the mask according to the first embodiment.

FIG. 9 is a diagram showing a state of a wearer wearing another modification of mask 100. In the example shown in FIG. 9, microphone 140 is provided at the lower end (the end located below the mouth of the wearer) at a side end of mask main body 110.

The position of microphone 140 can be varied as appropriate in mask main body 110. In the examples in FIGS. 3, 8, and 9, microphone 140 is located at a peripheral portion of mask main body 110.

According to mask 100 in the present embodiment, voice uttered by a wearer can be collected by microphone 140 without using a complicated structure or a significantly expensive component. In general, while the mask is worn, the mouth of the wearer is covered with the mask main body as the filter, and hence audibility of voice of the wearer may be lowered. When a conversation volume is high, on the other hand, privacy of contents of a conversation may not be protected. According to mask 100 according to the present embodiment, lowering in audibility can be suppressed and privacy of contents of a conversation can be protected. Such effects can be achieved with relatively low cost.

Figure 10:
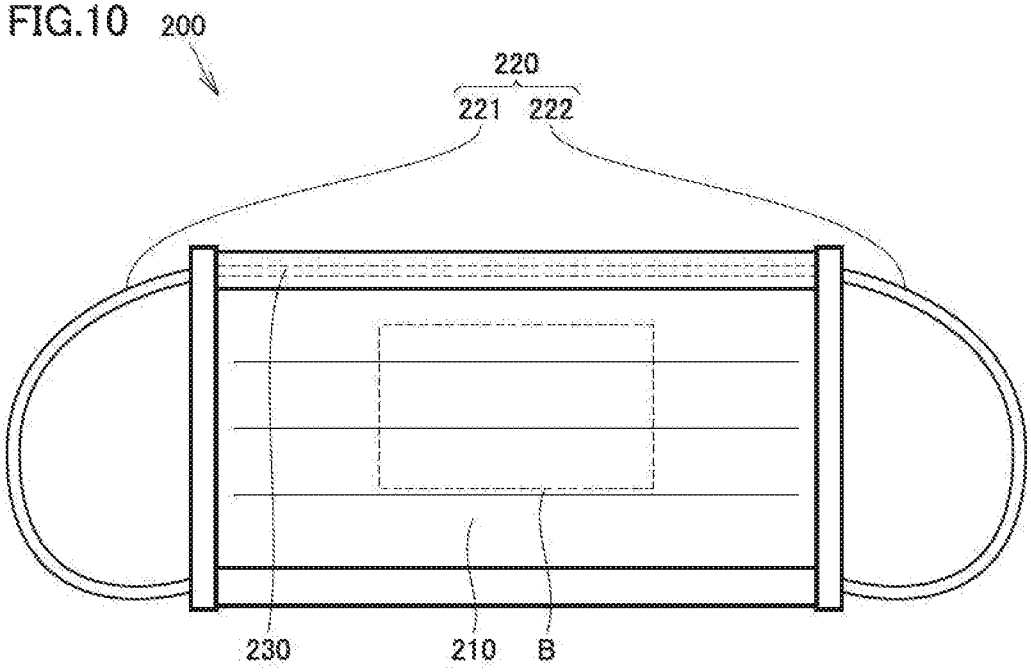
FIG. 10 is a front view of a mask according to a second embodiment.

FIG. 10 is a front view of a mask according to a second embodiment. As shown in FIG. 10, a mask 200 includes a mask main body 210, a strap portion 220, and a fitting portion 230.

Mask main body 210 is provided to cover the mouth of a wearer. Strap portion 220 includes strap members 221 and 222 in a form of a loop to be put over left and right ears of the wearer. Fitting portion 230 is provided at the upper end (the end located above the mouth of the wearer) of mask main body 210 and extends in the lateral direction of the face of the wearer.

Since description of mask main body 110, strap portion 120, and fitting portion 130 in the first embodiment can be applied to details of mask main body 210, strap portion 220, and fitting portion 230, detailed description thereof will not be repeated.

Mask 200 includes a sensor region B in a central portion of mask main body 210. Sensor region B may be provided over the entire mask main body 210 or at a position displaced from the central portion of mask main body 210.

Figure 11:
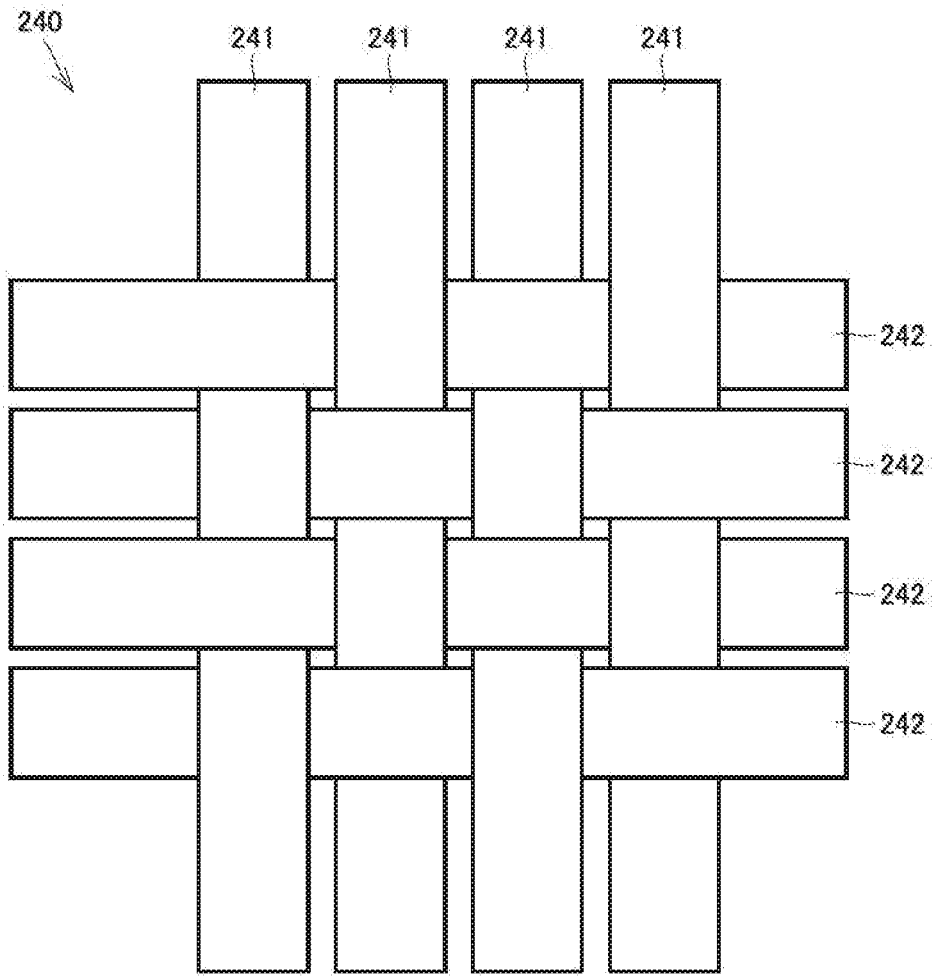
FIG. 11 is a diagram showing a structure of a sensor region in the mask according to the second embodiment.

FIG. 11 is a diagram showing a structure of sensor region B. As shown in FIG. 11, a sensor unit 240 provided in sensor region B includes PZT nanofibers 241 and platinum wires 242. PZT nanofibers 241 and platinum wires 242 intersect with each other in a substantially orthogonal direction.

Figure 12:
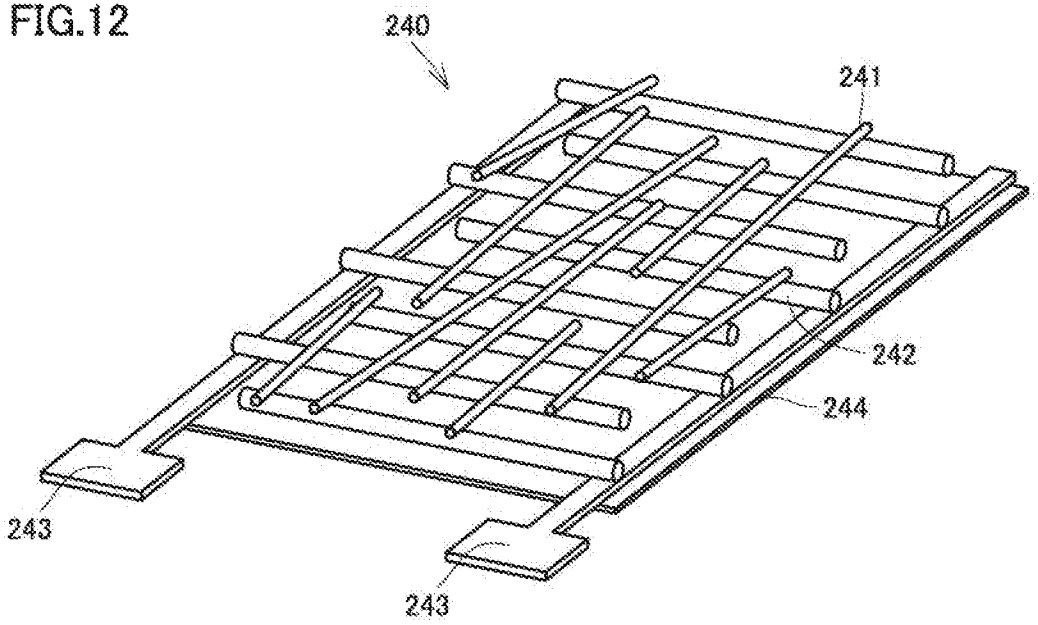
FIG. 12 is a diagram showing a structure of a sensor region in the mask according to the second embodiment.

FIG. 12 is a diagram showing the structure of sensor unit 240 in further detail. As shown in FIG. 12, sensor unit 240 further includes an electrode portion 243 and a silicon substrate 244. PZT nanofibers 241, platinum wires 242, electrode portion 243, and silicon substrate 244 form a cloth-like sheet containing piezoelectric fibers.

Platinum wire 242 has one end connected to only one of two electrode portions 243. Platinum wire 242 connected to one electrode portion 243 (on the right side in the figure) and platinum wire 242 connected to the other electrode portion 243 (on the left side in the figure) intersect with PZT nanofibers 241. Two electrode portions 243 are connected to a communication module which will be described later. The number of electrode portions 243 is not limited to two but may be set to three or more.

Figure 13:
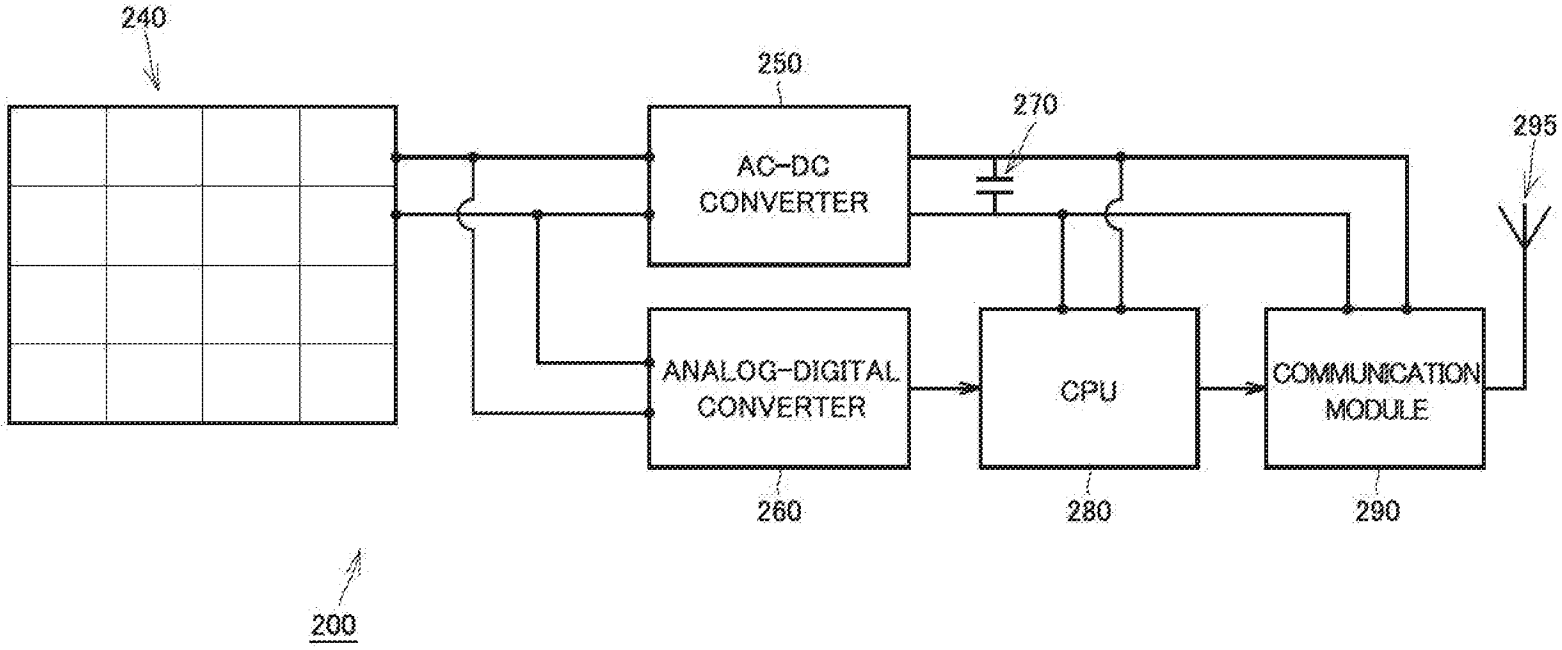
FIG. 13 is a diagram showing a configuration relating to a communication function in the mask according to the second embodiment.

FIG. 13 is a diagram showing a configuration relating to a communication function in mask 200. As shown in FIG. 13, mask 200 includes sensor unit 240, an alternating-current (AC)-direct current (DC) converter 250, an analog-digital converter 260, a capacitor 270, a CPU 280, a communication module 290, and an antenna 295.

Sensor unit 240 senses voice in a conversation by a wearer of mask 200 as a pressure and converts the pressure into electric power. A signal of voice sensed by sensor unit 240 is sent to communication module 290. Communication module 290 outputs an audio signal from antenna 295 in conformity with a wireless communication standard. Specific examples of the wireless communication standard include Bluetooth™. Output of an audio signal is not limited to output through wireless communication but wired communication can also be used. An audio signal output through wireless communication or wired communication from mask 200 is received by another device. Since another device has been described in the first embodiment, description thereof will not be repeated.

A signal of voice sensed by sensor unit 240 is sent also to CPU 280 through analog-digital converter 260. CPU 280 can control communication module 290 so as to output an audio signal only while voice in a conversation by a wearer of mask 200 is being sensed. Power consumed by communication module 290 can thus be reduced.

Specific examples of communication module 290 include EZ-BT™ WICED Module CYBT-343026-01 (Cypress Semiconductor Corporation). Other specific examples of communication module 290 include also RN4870-71 (Microchip Technology inc.).

A battery may be provided instead of capacitor 270 or a battery (not shown) may be added to capacitor 270, connected in parallel.

Figure 14:
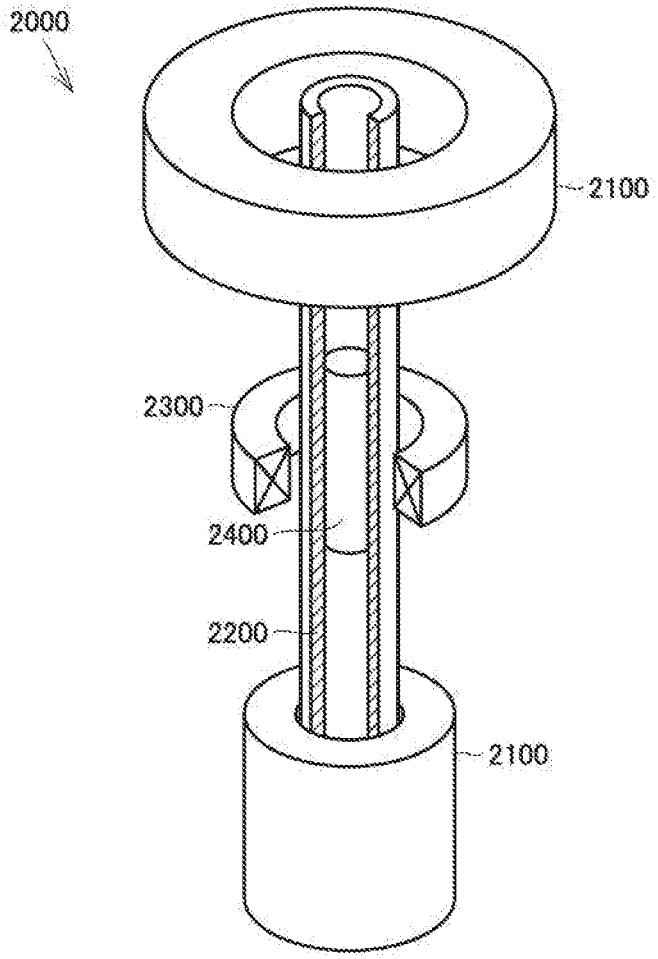
FIG. 14 is a diagram showing an exemplary energy harvester in the mask according to the second embodiment.

Mask 200 includes as a further feature, an energy harvester that generates power by using a pressure resulting from breathing by a wearer. An energy harvester 2000 shown in FIG. 14 includes a fixed magnet 2100, a tube 2200, a coil 2300, and a movable magnet 2400. A component described in Delnavaz et al., mentioned above, is applied as energy harvester 2000.

Mask 200 is worn to cover the mouth of the wearer. Therefore, a pressure applied by breathing by the wearer is constantly supplied. Energy harvester 2000 generates power by using the pressure resulting from breathing by the wearer. Generated power is stored in a power storage within mask 200. Stored power is used for output of an audio signal. As in the first embodiment, electric power of another device may be supplied to mask 200.

As described above, in mask 200, an audio signal is output only while voice in a conversation by the wearer is being sensed. While voice in a conversation by the wearer is not sensed, power is still generated by pressure resulting from breathing by the wearer and generated power is stored for powering output of an audio signal. Therefore, power consumption in the entire mask 200 can be reduced.

Thus, in mask 200 according to the present embodiment, by using a piezoelectric element, sensing of voice and power generation by using breathing are performed. Specific examples of a module including a piezoelectric element include PPA (Mide Technology Corp.). Specific examples of piezoelectric fibers contained in the piezoelectric element include Regular Fiber Composite (APC International, Ltd.).

According to mask 200 in the present embodiment, voice uttered by a wearer can be collected by sensor unit 240 without using a complicated structure or a significantly expensive component. Lowering in audibility of voice of the wearer while the mask is worn can be suppressed with relatively low cost. An audio signal is output only while voice in a conversation by the wearer of mask 200 is being sensed and power is generated by energy harvester 2000 by using a pressure resulting from breathing by the wearer so that power consumption can be reduced.

Figure 15:
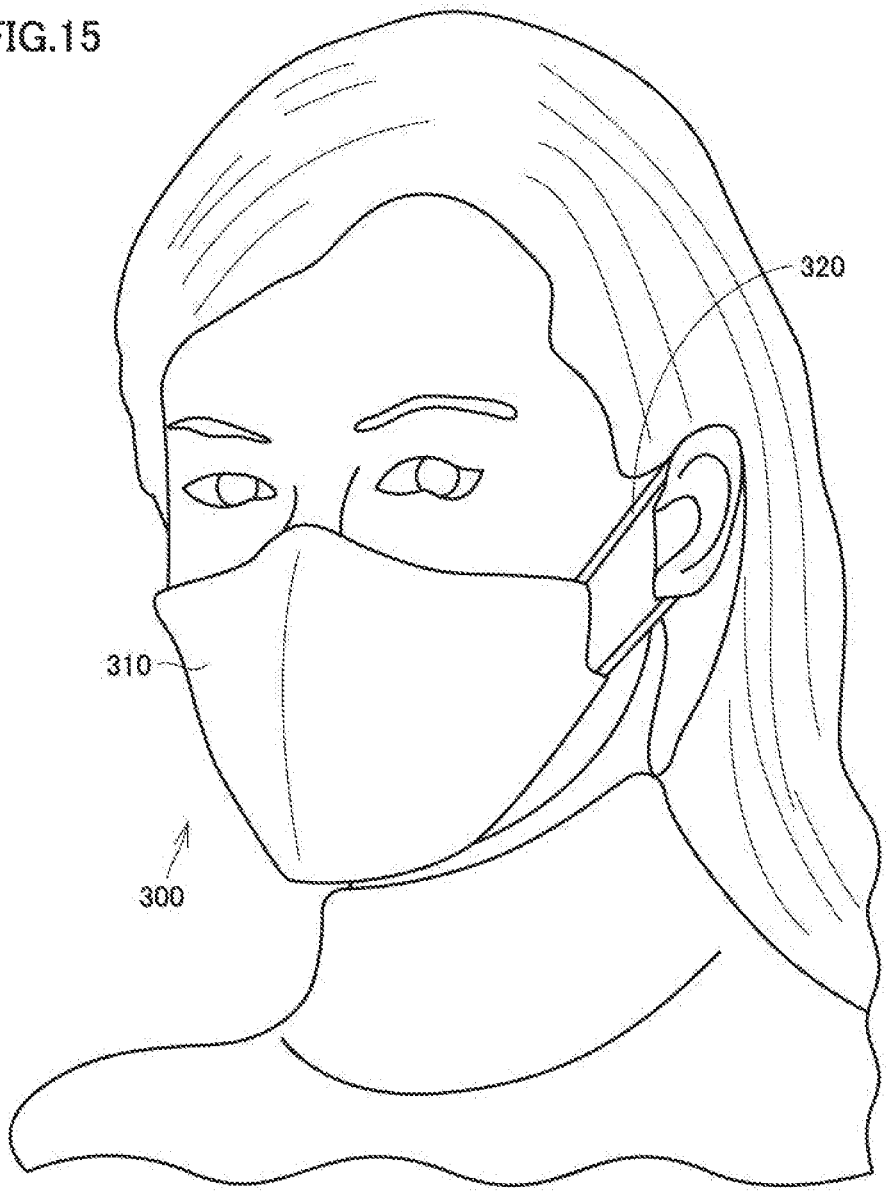
FIG. 15 is a diagram showing a state that a wearer wearing a mask according to a third embodiment.

FIG. 15 is a diagram showing a state of a wearer wearing a mask according to a third embodiment. A mask 300 according to the present embodiment is a modification of masks 100 and 200 according to the first and second embodiments and includes a mask main body 310 and a strap portion 320.

In mask 300, a shape of mask main body 310 is different from the shape (rectangular when unused) of mask main bodies 110 and 210 in the first and second embodiments. Mask main body 310 is vertically long in the central portion (along the centerline of the face of the wearer) in the lateral direction of mask 300.

Since the third embodiment is otherwise similar to the first and second embodiments, detailed description thereof will not be repeated.

Figure 16:
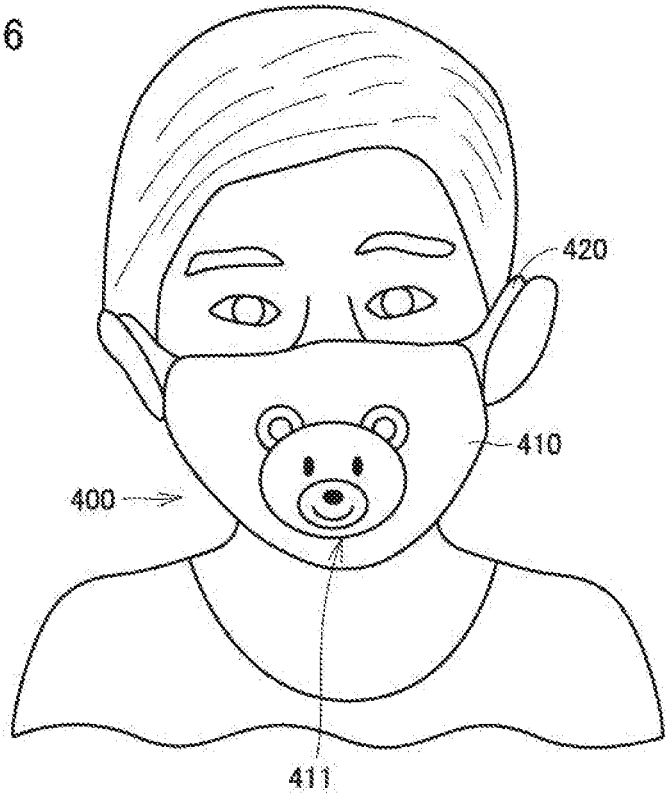
FIG. 16 is a diagram showing a state that a wearer wearing a mask according to a fourth embodiment.

FIG. 16 is a diagram showing a state that a wearer wearing a mask according to a fourth embodiment. A mask 400 according to the present embodiment is a modification of masks 100, 200, and 300 according to the first to third embodiments and includes a mask main body 410 and a strap portion 420.

In mask 400, an image 411 (an image or a picture) is printed on mask main body 410. The image or the picture is not limited to that shown in FIG. 16.

Since the fourth embodiment is otherwise similar to the first to third embodiments, detailed description thereof will not be repeated.

Though embodiments have been described, it should be understood that the embodiments disclosed herein are illustrative and non-restrictive in every respect. The scope of the present invention is defined by the terms of the claims and is intended to include any modifications within the scope and meaning equivalent to the terms of the claims.

What is claimed is:

1. A mask capable of covering a mouth of a wearer, the mask comprising:

a mask main body made of a cloth-like material;

a microphone arranged on the mask main body, and configured to collect voice of the wearer;

a cord connected to the microphone; and a support portion configured to rest on the nose of the wearer and support[s] the microphone, the support portion being higher in rigidity than the mask main body, the support portion being arranged along a channel across the full length of the upper end of the mask body, and at least a part of the cord being arranged in the channel.

2. The mask according to claim 1, wherein the cloth-like material is made of paper or contains synthetic fibers or natural fibers.

3. The mask according to claim 1, wherein an image or a picture is printed on the mask main body.

4. The mask according to claim 1, wherein the mask further includes a strap portion to be put over an ear of the wearer, and the strap portion forms an elastic loop.

5. The mask according to claim 1, wherein the mask further includes a strap portion to be put over an ear of the wearer, and the cloth-like material is connected to the strap portion and the cord is connected to the cloth-like material in the vicinity of a position where the cloth-like material is connected to the strap portion.

6. A method of manufacturing a mask, the method comprising:

obtaining a cloth like material having an upper end;

obtaining a microphone connected to a cord;

obtaining a support portion for resting on the nose of a wearer of the mask, the support portion having higher rigidity than the cloth like material;

attaching the microphone to the support portion;

arranging a the support portion, microphone, and cord along the upper end of the mask; and forming a channel across the full length of the upper end of the cloth like material, the channel surrounding the support portion, microphone, and cord.

7. The method of claim 6 further comprising:

attaching a strap to the upper end of the cloth like material; and attaching the cord to the strap in the vicinity of the position where the strap is connected to the cloth-like material.

8. The method of claim 6 further comprising:

printing an image on the cloth like material.

9. A method of wearing a mask having a support portion and a microphone attached to the support portion and a cord, the support portion, microphone, and cord being arranged within a channel at the upper end of the mask, the method comprising:

positioning the mask to cover the nose and mouth of a face with the support portion resting on the nose;

positioning at least a portion of a strap above the ear to hold the mask against the face; and positioning at least a portion of the cord over the ear, wherein the cord is adapted to connect to an audio device below the ear.

10. The method of claim 9 wherein, the mask has an image printed on it that indicates which side of the mask should face outward from the face.

* * * * *